US007303432B1

(12) United States Patent
Chen et al.

(10) Patent No.: US 7,303,432 B1
(45) Date of Patent: Dec. 4, 2007

(54) MOUNTING APPARATUS FOR INPUT/OUTPUT PORTS

(75) Inventors: Yun-Lung Chen, Tu-Cheng (TW); Ming-Xian Sun, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,886

(22) Filed: Oct. 17, 2006

(51) Int. Cl.
*H01R 13/60* (2006.01)

(52) U.S. Cl. ..... 439/540.1

(58) Field of Classification Search ..... 439/540.1, 439/607

See application file for complete search history.

(56) References Cited

U.S. PATENT DOCUMENTS 5,688,145 A * 11/1997 Liu ..... 439/607
6,165,014 A * 12/2000 Kao et al. ..... 439/607
6,655,992 B1 * 12/2003 Ko ..... 439/579
7,118,414 B2 * 10/2006 Spears et al. ..... 439/540.1
2004/0242070 A1 * 12/2004 Inoue et al. ..... 439/607
2005/0164548 A1 7/2005 Spears et al.

* cited by examiner

*Primary Examiner*—Tho D. Ta
(74) *Attorney, Agent, or Firm*—Wei Te Chung

(57) ABSTRACT

A mounting apparatus for I/O ports (14) of a computer includes an I/O port holder (10) for holding the I/O ports and a bracket (20) for holding and securing the I/O port holder. The bracket includes a front panel (21) and side panels (23, 25) extending from the front panel, a housing space configured by the front panel and the side panels being isometric to the I/O port holder for encasing the I/O port holder therein, at least an arc-shaped jut (2312) is formed on an interior surface of the enclosure panel. At least an arc-shaped recess (1231) engaging with the arc-shaped jut of the bracket is formed on an exterior surface of the I/O port holder for securing the I/O port holder.

13 Claims, 3 Drawing Sheets

MOUNTING APPARATUS FOR INPUT/OUTPUT PORTS

1. FIELD OF THE INVENTION

The present invention relates to mounting apparatuses, and more particularly to a mounting apparatus for an input/output port holder.

2. DESCRIPTION OF RELATED ART

Computer system usually includes input/output ports for a keyboard, mouse, joystick, microphone, video feed, video monitor, audio device and USB (Universal Serial Bus) connectors etc., thereby enhancing additional functions of the computer system. All the I/O ports should be secured onto the computer housing and accessable.

A conventional computer I/O connector assembly uses connector port holders that can be snapped into a metal retaining bracket. The connector assembly can then be attached onto the interior chassis of a computer housing. If desired, individual connector port holders can alternatively be snapped out of the bracket and replaced with other connector holders. The bracket is mounted on front of a computer tower. Connected to the bracket is a first connector port holder with two USB ports, a second connector port holder with an IEEE 1394 high speed communication port, a third connector port holder with three audio ports and a fourth connector holder with two video ports. Each connector port holders include movable cantilever strips with lock tabs formed on two upper corner and two lower corner thereof, which firmly snap into locking holes in the bracket for mounting.

However, it is time-consuming to install four individual I/O port holders and inconvenient to simultaneously press down on the upper and lower locking tabs until they clear the locking hole for removing the I/O port holders from the bracket.

What is needed, therefore, is a mounting assembly for I/O port holder allowing convenient assembly and disassembly.

SUMMARY OF THE INVENTION

A mounting apparatus for I/O ports of a computer includes an I/O port holder for holding the I/O ports and a bracket for holding and securing the I/O port holder. The bracket includes a front panel and side panels extending from the front panel, a housing space configured by the front panel and the side panels being isometric to the I/O port holder for encasing the I/O port holder therein, at least an arc-shaped jut is formed on an interior surface of the enclosure panel. At least an arc-shaped recess engaging with the arc-shaped jut of the bracket is formed on an exterior surface of the I/O port holder for securing the I/O port holder.

Other advantages and novel features will be drawn from the following detailed description of a preferred embodiment with attached drawings, in which:

DETAILED DESCRIPTION OF THE INVENTION

Figure 1:
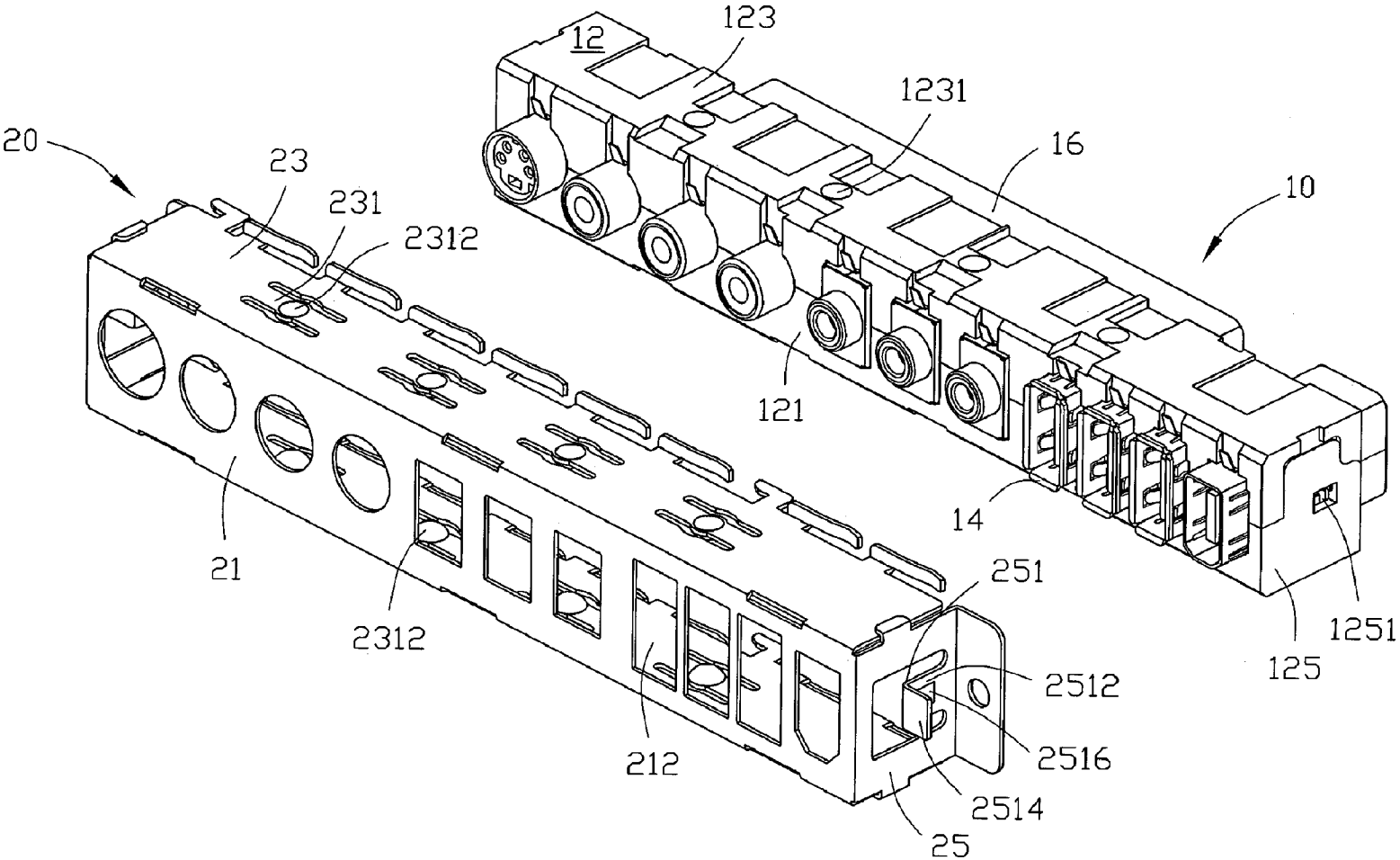
FIG. 1 is an exploded, isometric view of an I/O port holder and a bracket.

Referring to FIG. 1, a mounting apparatus for I/O ports includes an I/O port holder 10 and a bracket 20 incorporated into a computer which receives the I/O port holder 10.

The I/O port holder 10 includes a holding body 12 for holding various I/O ports 14 and protrusions 16 protruding from the holding body 12. The body 12 includes a front wall 121, a pair of parallel first side walls 123 and a pair of parallel second side walls 125. The I/O ports 14, including four USB ports, three audio ports, three video ports and an IEEE 1394 port protrude from the front wall 121. A plurality of arc-shaped recesses 1231 is defined in the first side walls 123. A fixing notch 1251 is defined in each of the second sidewalls 125.

Figure 3:
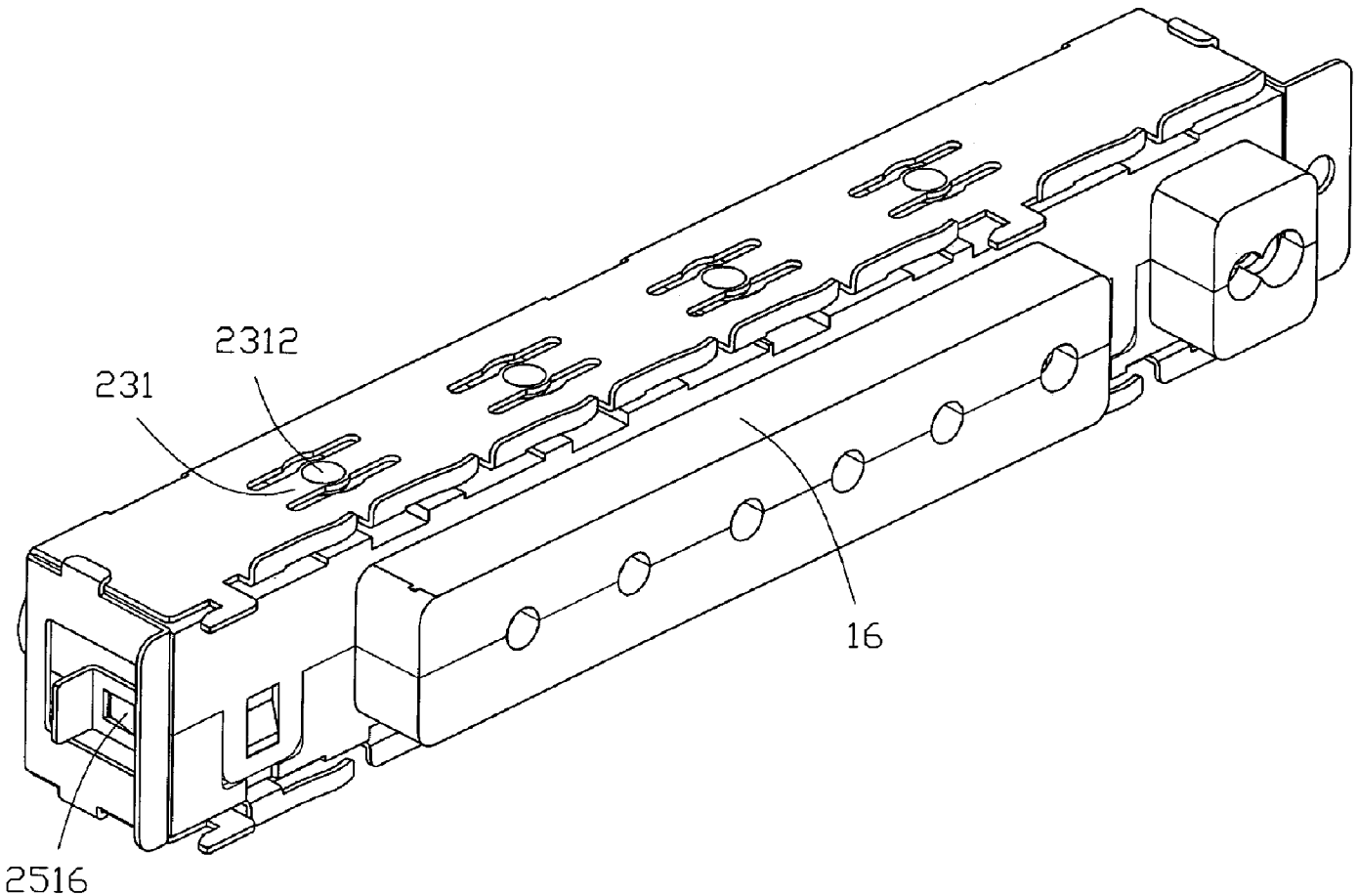
FIG. 3 is similar to FIG. 2, but viewed from another aspect.

Referring to FIG. 1 and FIG. 3, the bracket 20 includes a front panel 21, a pair of first side panels 23 extending perpendicularly from an upper edge and a lower edge of the front panel 21 respectively, and a pair of second side panels 25 extending perpendicularly from a left edge and a right edge of the front panel 21 respectively. A housing space formed by the front panel 21, the first side panels 23, and the second side panels 25 of the bracket 20 is shaped similarly to the holding body 12 of the I/O port holder 10 for accommodating the holding body 12 therein. A plurality of port openings 212 adapted for the I/O ports 14 respectively are defined in the front panel 21 of the bracket 20. A plurality of resilient pieces 231 is formed in the side panels 23. An arc-shaped jut 2312 corresponding to the arc-shaped-shaped recesses 1231 is protruding from the central part of the resilient piece 231 for engaging with the arc-shaped recess 1231. A resilient "L" shaped handle 251 is defined in each second side panel 25 of the bracket 20. The handle 251 includes a body 2512 and a bent portion 2514 extending perpendicularly from the body 2512. A fixing block 2516 for engaging in the fixing notch 1251 is formed on an interior surface of the body 2512 of each handle 251. Each fixing block 2516 is a slanting ascending protrusion protruding in from the corresponding handle 251 for facilitating pushing the I/O port holder 10 into the bracket 20. A thick end of each fixing block 2516 is near to the bent portion 2514 of the handle 251 (Showed in FIG. 3).

Figure 2:
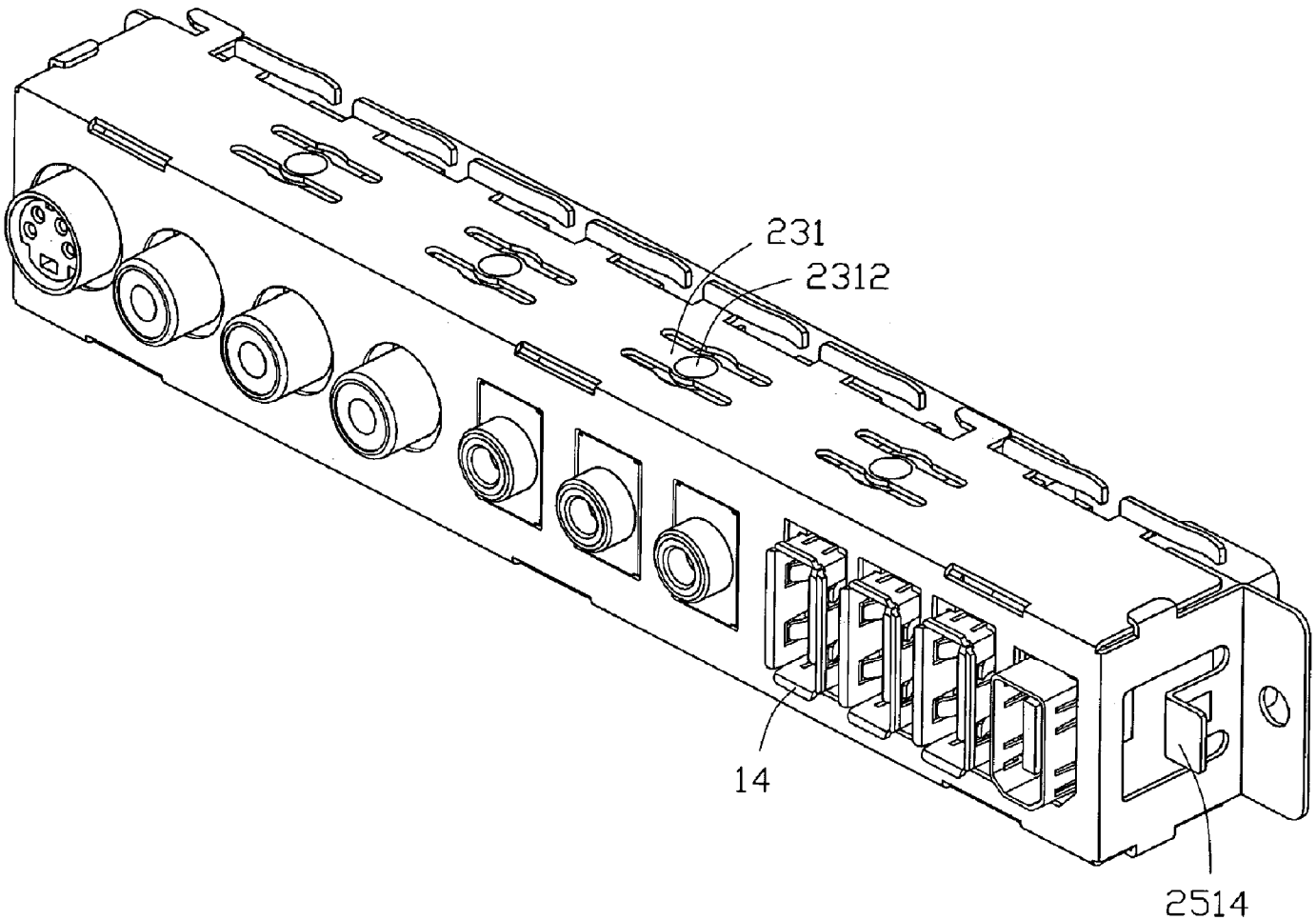
FIG. 2 is an assembled view of FIG. 1.

Referring to FIG. 1 and FIG. 2, in assembly, the I/O port holder 10 is pushed into the bracket 20, the resilient pieces 231 and the handles 251 of the bracket 20 are elastically deformed outwards for allowing entrance of the I/O port holder 10. When the arc-shaped juts 2312 of the bracket 20 wedge into the arc-shaped recesses 1231 of the I/O port holder 10 and the fixing blocks 2516 of the bracket 20 wedge into the fixing notches 1251 of the I/O port holder 10, the resilient pieces 231 of the bracket 20 and the handles 251 of the bracket 20 return to their original shape. The thick ends of the fixing blocks 2516 resist against the fixing notches 1251 of the I/O port holder 10 for securing the I/O port holder 10. The holding block 12 of the I/O port holder 10 is encased in and secured to the bracket 20. The protrusions 16 of the I/O port holder 10 protrude outward. The I/O ports 14 are extended through the port openings 212 of the bracket 20 respectively.

Referring to FIG. 3, in removing the I/O port holder 10 from the bracket 20, the bent portions 2514 of the handles 251 are turned outward until the fixing blocks 2516 of the bracket 20 disengage with the fixing notches 1251 of the I/O port holder 10, the I/O port holder 10 is removed out from the bracket 20 by pulling the protrusion 16 of the I/O port holder 10.

It is to be understood, however, that even though numerous characteristics and advantages have been set forth in the foregoing description of a preferred embodiment, together with details of the structure and function of the preferred embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mounting apparatus for I/O ports of a computer, comprising: an I/O port holder for holding the I/O ports, at least an arc-shaped recess being formed on an exterior surface of the I/O port holder; and a bracket for holding and securing the I/O port holder, the bracket comprising a front panel and side panels extending from the front panel, a housing space configured by the front panel and the side panels being isometric to the I/O port holder for encasing the I/O port holder therein, at least an arc-shaped jut being formed on an interior surface of the side panels for engaging with the arc-shaped recess of the I/O port holder and thus securing the I/O port holder;

wherein at least a resilient piece is formed in the enclosure panel of the bracket, and the arc-shaped jut is formed on the resilient piece.

2. The mounting apparatus as described in claim 1, wherein a plurality of port openings is defined in the front panel of the bracket.

3. The mounting apparatus as described in claim 1, wherein at least a fixing notch is defined in the I/O port holder, and at least a fixing block for wedging into the fixing notch is formed on one of the side panels of the bracket.

4. The mounting apparatus as described in claim 3, wherein the fixing block is a slanting ascending protrusion.

5. The mounting apparatus as described in claim 3, wherein at least a handle is formed in the one of the side panels of the bracket, the fixing block protruding from the handle.

6. The mounting apparatus as described in claim 5, wherein the handle is L-shaped and comprises a resilient body and a bent portion extending perpendicularly from the body, the fixing block protruding from an interior surface of the body.

7. A mounting assembly incorporated into a computer comprising: a plurality of I/O ports;

an I/O port holder for holding the I/O ports, an arc-shaped recess and a fixing notch being defined in the I/O port holder;

and a bracket which accommodates and secures the I/O port holder, an arc-shaped jut engaging into the arc-shaped recess and a fixing block engaging into the fixing notch being formed on the bracket;

wherein the bracket comprises a front panel and side panels extending from the front panel, a housing space configured by the front panel and the side panels is isometric to the I/O port holder for interferentially encasing the I/O port holder therein;

wherein the side panels comprise a pair of first side panels extending perpendicularly from an upper edge and a lower edge of the front panel, and a pair of second side panels extending perpendicularly from a left and a right edge of the front panel, the arc-shaped jut is formed on an interior surface of the first panel, a resilient handle is formed in the second side panel, the fixing block is formed on the resilient handle.

8. The mounting assembly as described in claim 7, wherein the resilient handle is L-shaped.

9. The mounting assembly as described in claim 7, wherein a plurality of port openings configured for exposing the I/O ports are defined in the front panel of the bracket.

10. The mounting assembly as described in claim 7, wherein the I/O port holder comprises a front wall, a pair of first side walls extending perpendicularly from an upper edge and a lower edge of the front wall, and a pair of second side walls extending perpendicularly from a left and a right edge of the front wall, the arc-shaped recess is defined in the first side wall, the fixing notch is defined in the second side wall.

11. The mounting assembly as described in claim 7, wherein an L-shaped handle is formed at the bracket and comprises a body and a bent portion extending perpendicularly from the body, the body is resilient, and the fixing block protrudes from an interior surface of the body.

12. A mounting apparatus comprising:

an I/O port holder configured for holding I/O ports thereto, the holder comprising a plurality of side walls;

a bracket comprising a front panel and a plurality of side panels extending rearward from the front panel, the front panel and the side panels cooperatively forming a housing for accommodating the I/O port holder therein, the front panels defining a plurality of openings for exposing the I/O ports, the side panels of the bracket facing the side walls of the I/O port holder respectively;

a plurality of dome-shaped projections being formed at an exterior of the side walls and a plurality of recess being formed at an interior of the side panels for fittingly receiving the projections respectively; and a fixing notch being defined in one of the I/O port holder and the bracket and a fixing block being formed at the other one of the I/O port holder and the bracket for engaging into the fixing notch to lock I/O port holder with the bracket;

wherein the bracket comprises a cantilever L-shaped handle formed at one of the side panels, the fixing block being formed at an interior of the handle.

13. The mounting apparatus as claimed in claim 12, wherein the projections are spaced from the front panel and a part of the I/O port holder passes across the projections when I/O port holder is slid into the bracket.

* * * * *